US005457445A

United States Patent [19]

Su

[11] Patent Number: 5,457,445

[45] Date of Patent: Oct. 10, 1995

[54] SAFETY PLUG FOR ELECTRICAL APPLIANCES

[76] Inventor: Tun L. Su, No. 90, Chung Cheng Road, Lu-Chu Country, Kaohsiung City, Taiwan

[21] Appl. No.: 355,018

[22] Filed: Dec. 13, 1994

[51] Int. Cl.[6] ..... H01H 85/02; H01H 85/143; H01R 13/68; H01R 25/00

[52] U.S. Cl. ..... 337/198; 337/255; 439/622; 439/638

[58] Field of Search ..... 337/197, 198, 337/190, 216, 256, 260, 261, 262, 263, 264; 439/638, 833, 839, 620, 622

[56] References Cited

U.S. PATENT DOCUMENTS

| | | | |
|---|---|---|---|
| 2,528,971 | 11/1950 | Philips . | |
| 2,636,097 | 4/1953 | Shapiro . | |
| 2,777,916 | 1/1957 | Cooper . | |
| 3,833,875 | 9/1974 | Holoka | 337/269 |
| 4,275,374 | 6/1981 | Chaucer | 337/197 |
| 4,679,877 | 7/1987 | Ahroni | 439/425 |
| 4,752,243 | 6/1988 | Meidan | 439/622 |
| 4,904,976 | 2/1990 | Liaq | 337/197 |
| 5,249,986 | 10/1993 | Lu | 439/622 |
| 5,281,943 | 1/1994 | Liao | 337/198 |
| 5,320,563 | 6/1994 | Liao | 439/622 |

FOREIGN PATENT DOCUMENTS

| | | | |
|---|---|---|---|
| 1259497 | 1/1972 | United Kingdom | 439/622 |

*Primary Examiner*—Leo P. Picard
*Assistant Examiner*—Stephen T. Ryan
*Attorney, Agent, or Firm*—Morton J. Rosenberg; David I. Klein

[57] ABSTRACT

Disclosed is a safety plug for electrical appliances and mainly includes an upper casing, a lower casing, two pole pins, a cylindrical cartridge fuse and a fuse terminal. The upper casing and the lower casing are slidably and detachably connected with each other by engagement of teeth provided at inner side walls of the upper casing and retaining hooks provided at outer side walls of the lower casing. One of the pole pins is provided at its rear end with an arcuated wrapping conductor to fitly and firmly wrap around a lower half of a first end of the cartridge fuse. The fuse terminal is provided with an Ω-shaped wrapping conductor to fitly and firmly wrap around a lower half of a second end of the cartridge fuse. These arrangements allow the cartridge fuse to correctly sense the current passing therethrough and the fuse wire in the cartridge fuse to be burned out at overload.

2 Claims, 5 Drawing Sheets

SAFETY PLUG FOR ELECTRICAL APPLIANCES

BACKGROUND OF THE INVENTION

Plugs and sockets are required in the use of electrical appliances using alternating current so as to connect necessary power supply. When there is only one electrical appliance plugged in a socket, the socket may not have a load that is too high. However, when there are multiple electrical appliances plugged in one single socket at the same time, the socket shall very possibly become dangerously overloaded. Safety plug with individual fuse is therefore developed to prevent the possible danger and damage caused by an overloaded socket.

A conventional plug for electrical appliances usually has a simple structure which mainly includes a casing, two pole (positive and negative) pins, and a wire or cable fixedly connected to one end of the casing opposite to the two pole pins.

Please refer to FIG. 7, in which a conventional safety plug 1 is shown. The plug 1 has a casing 12 and an inner sleeve 18. A first pole pin 11 of the plug 1 having a clamping leg 14 is inserted into the sleeve 18 such that the clamping leg 14 engages with a partition plate 13 provided in the sleeve 18 near one side thereof. A cartridge fuse 15 is disposed in the sleeve 18 to contact at a first end with an inward side of the clamping leg 14 so that the cartridge fuse 15 may sense the current flowing from the pole pins to a generally U-shaped fuse terminal 10 disposed at a second end of the cartridge fuse 15 opposite to the first end thereof. When the load of the fuse terminal 10 is too high, fuse wire in the cartridge fuse 15 is burned out and the circuit is open. The casing 12 is formed with a long opening 16 which is opened or closed by means of a top cover 17. The change of new cartridge fuse 15 can be easily done through the long opening 16.

Following disadvantages exist in the above described safety plug:

1. The casing 12 is integrally made of plastic material by means of injection modeling. The inner sleeve 18 is inserted into the casing 12 after the latter is cooled and becomes solid. This assembling manner does not permit convenient and quick replacement and assembling of components inside the casing 12 and therefore requires higher manufacture costs.

2. The cartridge fuse 15 is in a cylindrical form, the first end thereof is connected with the clamping leg 14 of the first pole pin 11 and the second end thereof with the fuse terminal 10. Due to its cylindrical configuration, the cartridge fuse 15 tangentially contacts with the side wall of the clamping leg 14 of the first pole pin 11 and of the U-shaped fuse terminal 10. That is, the cartridge fuse 15 only senses a smaller current tangentially flowing therethrough even though there is actual higher current passing through the circuit. In other words, the cartridge fuse 15 disposed in the plug with the above conventional design can not fully reflect the correctly overloaded current through the burning out of fuse therein. Moreover, whenever the cylindrical cartridge fuse 15 slightly deviates from the side walls of the clamping leg 14 of the first pole pin 11 and/or the U-shaped fuse terminal 10 and separates from the tangential contact with them, it will completely lose its safe-guard function and the electrical appliance on which the cartridge fuse 15 is disposed shall be in an uncertain and dangerous condition.

SUMMARY OF THE INVENTION

It is therefore a primary object of the present invention to provide a safety plug for electrical appliances which eliminates the shortcomings existed in the conventional safety plugs which are not convenient and economical in manufacture and not safe in use.

BRIEF DESCRIPTION OF THE DRAWINGS

The structure and features of the present invention may be best understood through the following detailed description of the preferred embodiments and the accompanying drawings wherein.

DETAILED DESCRIPTION OF THE PREFERRED EMBODIMENTS

Figure 1:
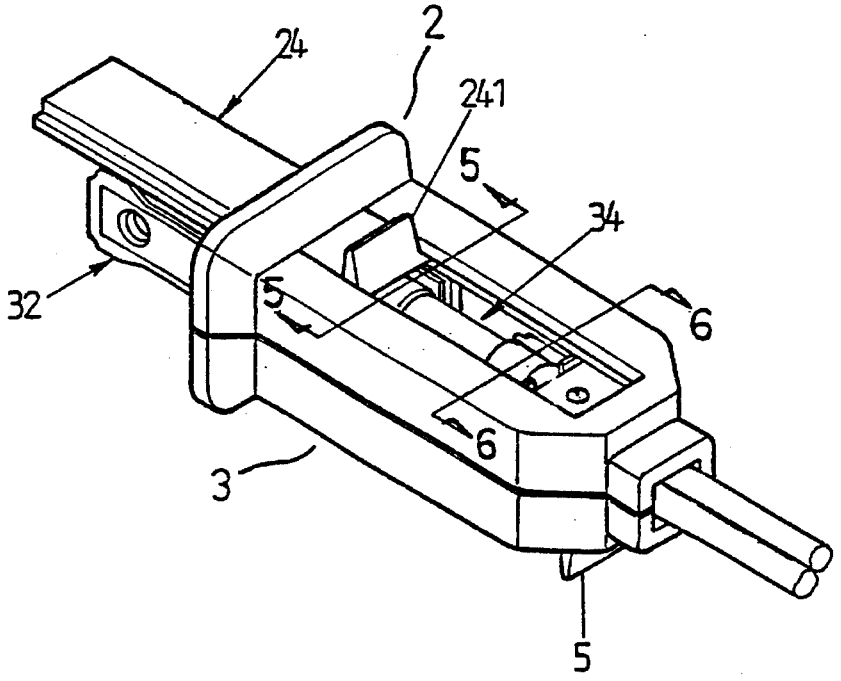
FIG. 1 is an assembled perspective of the present invention.
Figure 3:
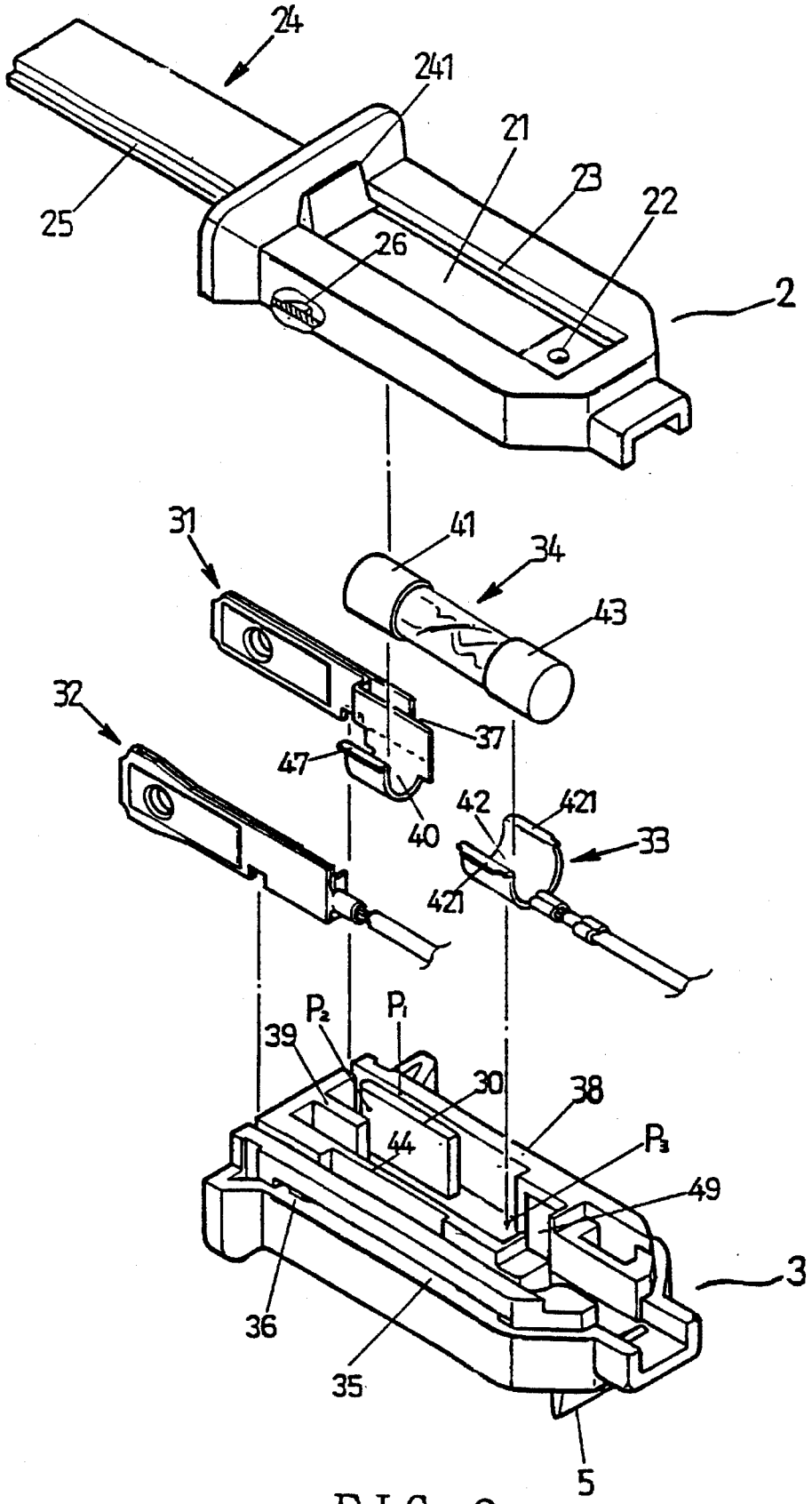
FIG. 3 is a disassembled perspective of the present invention.

Please refer to FIGS. 1 and 3. The safety plug according to the present invention mainly includes an upper casing 2 and a lower casing 3.

The upper casing 2 is provided at its top central portion with a longitudinal opening 21. A horizontally projected rail 23 is provided at each longitudinal edge of the opening 21. A top cover 24 having a configuration corresponding to the opening 21 and having two grooves 25 provided at two longitudinal edges thereof corresponding to the two rails 23 of the upper casing 2 may slidably move in the opening 21 along the rails 23 by engagement of the two side grooves 25 with the two rails 23 of the upper casing 2. With the flexibility of the plastic material, the top cover 24 may be forced to pass over a boss 22 provided at a rear portion of the upper casing 2 and be stopped thereat when the top cover 24 is moved backward to close the opening 21. The top cover 24 further has an upward projected wall 241 provided at its rear end for easy operation by a user. Furthermore, several projected teeth 26 are provided at an inner surface of two side walls of the upper casing 2.

Figure 2:
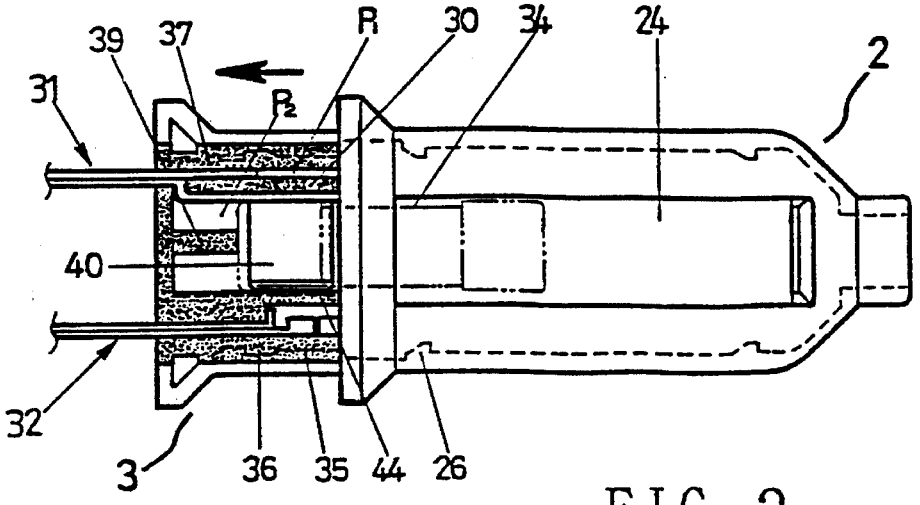
FIG. 2 illustrates the manner in which the upper and the lower casings of the present invention engaging with each other.

Please now refer to FIGS. 2 and 3 at the same time. The lower casing 3 serves as a seat for two pole pins 31, 32, a fuse terminal 33, and a cartridge fuse 34. The lower casing 3 is provided at an outer surface of its two side walls each with a sideward opened groove 35 along which a number of retaining hooks 36 are formed corresponding to the numbers and locations of the teeth 26 of the upper casing 2, such that the upper casing 2 may be pushed to move along the grooves 35 with the teeth 26 extending into the grooves 35, and be fixed to a certain point when the teeth 26 are stopped by the retaining hooks 36 in the grooves 35. A downward projected bottom wall 5 is provided at a bottom side of the lower casing 3 at a position corresponding to the wall 241 of the top cover 24 for easy removal of the plug from a socket by the user.

Figure 5:
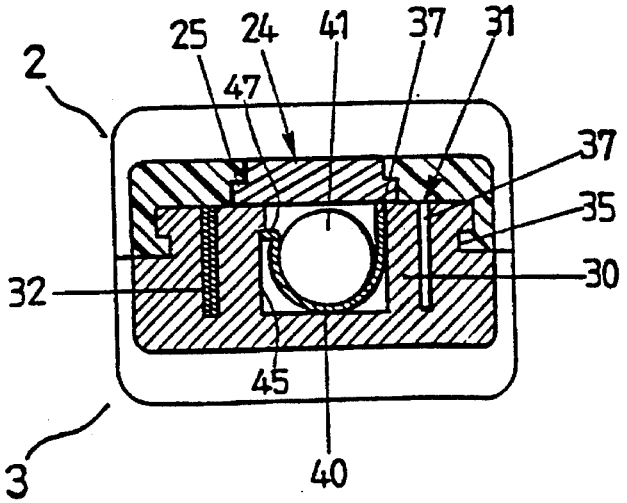
FIG. 5 is a sectional view taken on line A—A of FIG. 1.

Please now refer to FIGS. 3 and 5. The lower casing 3 has a partition 30 erected thereinside to form a small space P1 between the partition 30 and a side wall 38 of the lower casing 3 and another space P2 between the partition 30 and a middle wall 39 opposite to the space P1, such that a clamping leg 37 of the pole pin 31 can be fitly and firmly located in the spaces P1 and P2. An arcuated extension 40 laterally extends from an inner side of the clamping leg 37 to serve as a wrapping conductor to fitly wrap around a lower half of a first metal connection 41 attached to a first end of the cylindrical cartridge fuse 34.

Figure 4:
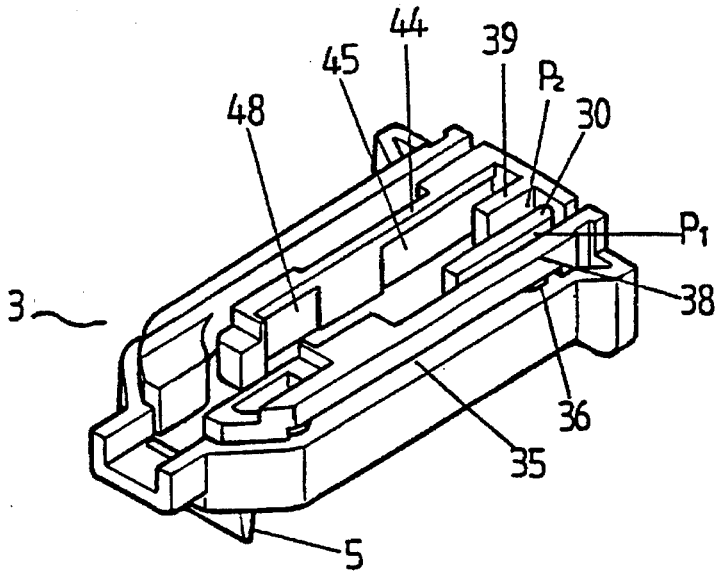
FIG. 4 illustrates the lower casing of the present invention.
Figure 6:
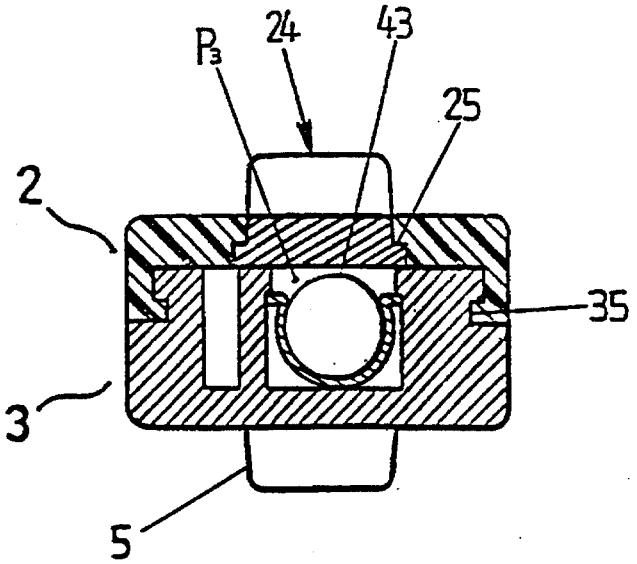
FIG. 6 is a sectional view taken on line B—B of FIG. 1.
Figure 6A:
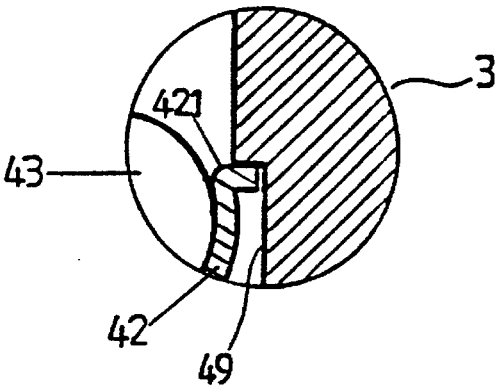
FIG. 6A is a fragmentary, enlarged and sectional view of FIG. 6 showing in detail the position of the omega-shaped wrapping conductor between the metal connection and the lower casing of the present invention system.
Figure 7:
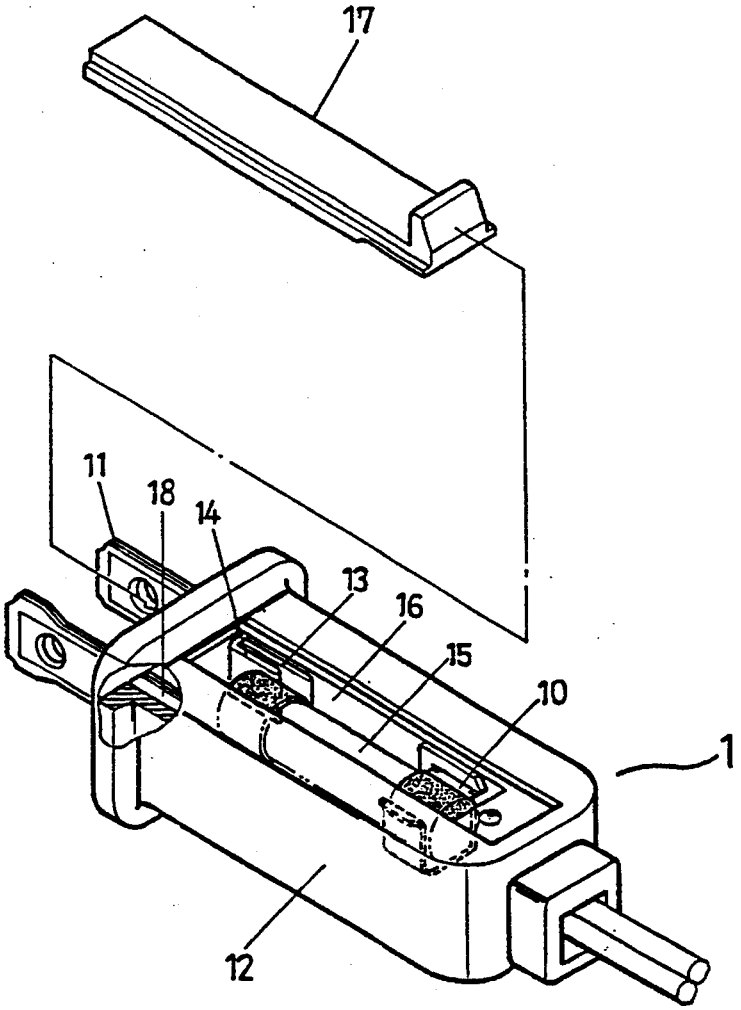
FIG. 7 PRIOR ART
FIG. 7 is a conventional safety plug for electrical appliances.
Figure 7A:
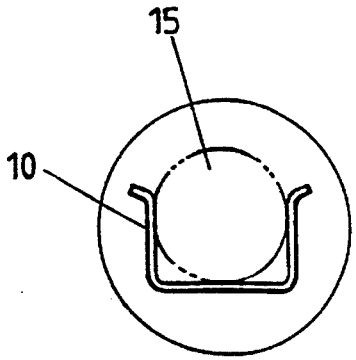
FIG. 7 A PRIOR ART
FIG. 7A is a fragmentary, enlarged and sectional view of FIG. 7 showing the tangential contact of a cartridge fuse with a U-shaped fuse terminal in the conventional safety plug.

Please refer to FIGS. 3, 4 and 6. A fuse terminal 33 having a substantially Ω-shaped wrapping conductor 42 is used to fitly wrap around a lower half of a second metal connection 43 attached to a second end of the cylindrical cartridge fuse 34. As shown in FIG. 4, a stop wall 44 is formed inside the lower casing 3 at the other side of the middle wall 39 opposite to the partition 30. The stop wall 44 is provided at its inner side facing the middle wall 39 with a longitudinal shallow recess 45 to receive a flange 47 adjacent to and laterally projected from an upward opening of the arcuated extension 40 and prevent the wrapping conductor 40 from turning or sliding in the lower casing 3. In the same manner, shallow recesses 48, 49 are provided at the inner surfaces of the side wall 38 and of the stop wall 44, respectively, corresponding to the second metal connection 43 of the cylindrical cartridge fuse 34. The Ω-shaped wrapping conductor 42 is disposed in a space P3 formed between the side wall 38 and the stop wall 44 such that two laterally projected flanges 421 of the wrapping conductor 42 are fitly received in the two recesses 48, 49 without being easily turned or slided.

One of the features of the present invention is that both the arcuated wrapping conductor 40 of the clamping leg 37 and the arcuated wrapping conductor 42 of the fuse terminal 33 have a curve configuration the same as that of the first and the second metal connections 41, 43 of the cartridge fuse 34, such that they can fitly and firmly wrap around and contact with the lower halves of the metal connections 41, 43 and to allow current to stably flow therethrough. That is, the cartridge fuse 34 can correctly sense the current flowing therethough and, when the load thereof is too high, the fuse wires inside the cartridge fuse 34 are burned out to cut off the current and to protect the safe use of the electrical appliance connected to the power supply through the safety plug and the socket.

The advantages of the present invention include:

1. The upper casing 2 can be easily, firmly, and detachably attached to the lower casing 3 by engaging its side teeth 26 with the side retaining hooks 36 of the lower casing 3. The labor and time for assembly and the manufacture cost thereof can be largely reduced.

2. Due to the arcuated wrapping conductor 40 and the substantially Ω-shaped wrapping conductor 42, the lower halves of the cylindrical cartridge fuse 34 at two ends thereof can be fitly and firmly wrapped around by the two wrapping conductors 40, 42 to correctly sense the current flowing therethough. And, the two wrapping conductors 40, 42 are well retained in the corresponding recesses without being easily turned and slided and separating from the contact with the cartridge fuse 34.

3. The actual contact of the cartridge fuse 34 with the pole pin 31 and the fuse terminal 33 is ensured by the curve wrapping conductors 40, 42, respectively, and therefore, a definite sensing of passing current and a timely burning out of the fuse wire in the cartridge fuse 34 at overload to cut off the current can be ensured, too.

The above embodiment is only used for illustration and is not intended to limit the scope of the present invention. Many modifications of the embodiment can be made without departing from the spirit of the present invention.

What is claimed is:

1. A safety plug for electrical appliances comprising an upper casing, a lower casing, a first and a second pole pins, a cylindrical cartridge fuse, and a fuse terminal, being characterized in that said upper casing is provided at an inner surface of its two side walls with several projected teeth and said lower casing is provided at an outer surface of its two side walls each with a sideward opened groove along which a number of retaining hooks are formed corresponding to the numbers and locations of said teeth of said upper casing such that said upper casing may be pushed to move along said grooves with said teeth extending into said grooves and be fixed to a certain point when said teeth are stopped by said retaining hooks in said grooves; that said lower casing has a partition erected thereinside to form a first space between said partition and a side wall of said lower casing and a second space between said partition and a middle wall opposite to said first space such that a clamping leg of said first pole pin is fitly and firmly located in said first and said second spaces; that said clamping leg has an arcuated extension laterally extending from an inner side of said clamping leg to serve as a wrapping conductor to fitly wrap around a lower half of a first metal connection attached to a first end of said cylindrical cartridge fuse; and that said fuse terminal has a substantially Ω-shaped wrapping conductor formed at one end thereof to fitly wrap around a lower half of a second metal connection attached to a second end of said cylindrical cartridge fuse.

2. A safety plug for electrical appliances as claimed in claim 1, wherein said lower casing is formed thereinside with a stop wall at another side of said middle wall opposite to said partition, said stop wall being provided at an inner side facing said middle wall with a first longitudinal shallow recess to receive a flange adjacent to and laterally projected from an upward opening of said arcuated wrapping conductor and to prevent said arcuated wrapping conductor from turning or sliding in said lower casing; said side wall and said stop wall of said lower casing being respectively provided at their inner surface with a second shallow recess corresponding to said second metal connection of said cylindrical cartridge fuse, and said Ω-shaped wrapping conductor being disposed in a space formed between said side wall and said stop wall such that two laterally projected flanges of said Ω-shaped wrapping conductor are fitly received in said two second recesses without being easily turned or slided.

* * * * *